United States Patent [19]

Eriksson

[11] Patent Number: 4,559,104

[45] Date of Patent: Dec. 17, 1985

[54] APPARATUS FOR DISCHARGING MATERIAL

[75] Inventor: Erik S. Eriksson, Karlstad, Sweden

[73] Assignee: KMW Aktiebolag, Karlstad, Sweden

[21] Appl. No.: 644,246

[22] Filed: Aug. 27, 1984

[30] Foreign Application Priority Data

Sep. 16, 1983 [SE] Sweden ..... 8304979

[51] Int. Cl.[4] ..... D21F 1/02; G01F 11/22

[52] U.S. Cl. ..... 162/336; 162/342; 222/412; 366/323; 425/381; 425/466

[58] Field of Search ..... 162/336–339, 162/344–347, 293, 341, 342; 198/661; 239/675; 366/89, 323, 186; 425/381, 465, 466, 208; 222/412, 414

[56] References Cited

U.S. PATENT DOCUMENTS

| | | | |
|---|---|---|---|
| 838,686 | 12/1906 | Case | 162/342 |
| 2,229,422 | 1/1941 | Schade et al. | 425/376 R |
| 2,504,787 | 4/1950 | Bailey | 239/675 |
| 2,929,449 | 3/1960 | Mardon et al. | 162/337 |
| 3,051,233 | 8/1962 | Baxter, Jr. | 162/337 |
| 3,061,008 | 10/1962 | Walker | 162/338 |
| 3,067,815 | 12/1962 | Flaig et al. | 162/336 |
| 3,137,895 | 6/1964 | Kusch | 425/382 |
| 3,559,561 | 2/1971 | Page | 425/466 |
| 3,563,853 | 8/1971 | Fair | 162/342 |
| 3,754,847 | 8/1973 | Sawada et al. | 425/462 |
| 3,924,841 | 12/1975 | Fair | 366/323 |
| 4,112,519 | 12/1978 | Kruder | 366/323 |

*Primary Examiner*—S. Leon Bashore
*Assistant Examiner*—K. M. Hastings
*Attorney, Agent, or Firm*—Bell, Seltzer, Park & Gibson

[57] ABSTRACT

An apparatus is disclosed for discharging material through an elongate aperture in a substantially constant amount per unit length of said aperture. The apparatus comprises a screw discharging unit having an inlet end and including a screw housing with a casing wall and a screw rotatably mounted in the screw housing. The elongate aperture is provided in the casing wall and extends substantially parallel to the axis of rotation of said screw. The screw has a core and at least one screw blade extending around the core and having a predetermined pitch for feeding the material from said inlet end to the elongate aperture. The core and said casing wall define therebetween a space having an annular cross section area successively decreasing in the direction of feed of the screw.

13 Claims, 5 Drawing Figures

M
L
x
d
D
III

APPARATUS FOR DISCHARGING MATERIAL

FIELD AND BACKGROUND OF THE INVENTION

The present invention relates to an apparatus for discharging material through an elongate aperture at a substantially constant amount per unit length of said aperture. The invention is particularly useful as a headbox for a paper machine.

In conventional headboxes for paper machines, the flow of stock is distributed by maintaining a dynamic pressure in the headbox, as described in Canadian Patent Specification No. 597,574, for example. However, any disturbance on either side of the discharge aperture will immediately cause a disturbance in the flow per unit width with respect to the web being formed. A number of different measuring and control devices have therefore been proposed in order to control the flow, most of such devices being complicated.

U.S. Pat. No. 3,051,233 describes another type of headbox in which an excess of the stock is brought to pass through a cylinder from one end to the other wherein a main portion of the stock passes through perforations in the cylinder communicating with a longitudinal passage which receives the stock before it flows out onto a wire through an adjustable discharge aperture. A rotating tapered mandrel is arranged inside the cylinder to distribute the flow along said passage. However, this tapered mandrel exerts no feeding action on the stock, and the stock will not therefore be distributed in a uniform flow per unit length of said passage. A further drawback is the fact that fibers become caught in the perforations so that the perforations will be clogged, despite special bars provided on the tapered mandrel to keep the perforations open by means of repeated alterations in pressure. The known headbox according to this U.S. patent is also limited to stock of low concentration.

German Patent Specification No. 613,380 describes a headbox for a paper machine which includes a number of parallel, vertically arranged screws having separate inlets, the outlets of the screws communicating with a common chamber in which the stock, due to the arrangement of the screws, will have a turbulence course near each screw outlet before the stock is discharged through a horizontal slot of the headbox.

SUMMARY OF THE INVENTION

The object of the present invention is to provide a discharge apparatus, such as a headbox for a paper machine, ensuring a uniform flow of material per unit length of an elongate aperture. Accordingly, the present invention resides in an improved discharge apparatus for discharging material through an elongate aperture in a substantially constant amount per unit length of said aperture, and which comprises a screw discharging unit including an inlet end and a screw housing with a casing wall and a screw rotatably mounted in the screw housing. The elongate aperture is arranged in the casing wall substantially parallel to the axis of rotation of said screw, and the screw has a core and at least one screw blade extending around the core and having a predetermined pitch for feeding the material from said inlet end to said elongate aperture. The core and said casing wall defines therebetween a space having an annular cross section area successively decreasing in the direction of feed of the screw.

BRIEF DESCRIPTION OF THE DRAWINGS

The invention will be described further in the detailed description which follows, with reference to the accompanying drawings, in which.

DESCRIPTION OF ILLUSTRATED EMBODIMENTS

Figures 1, 2, 3:
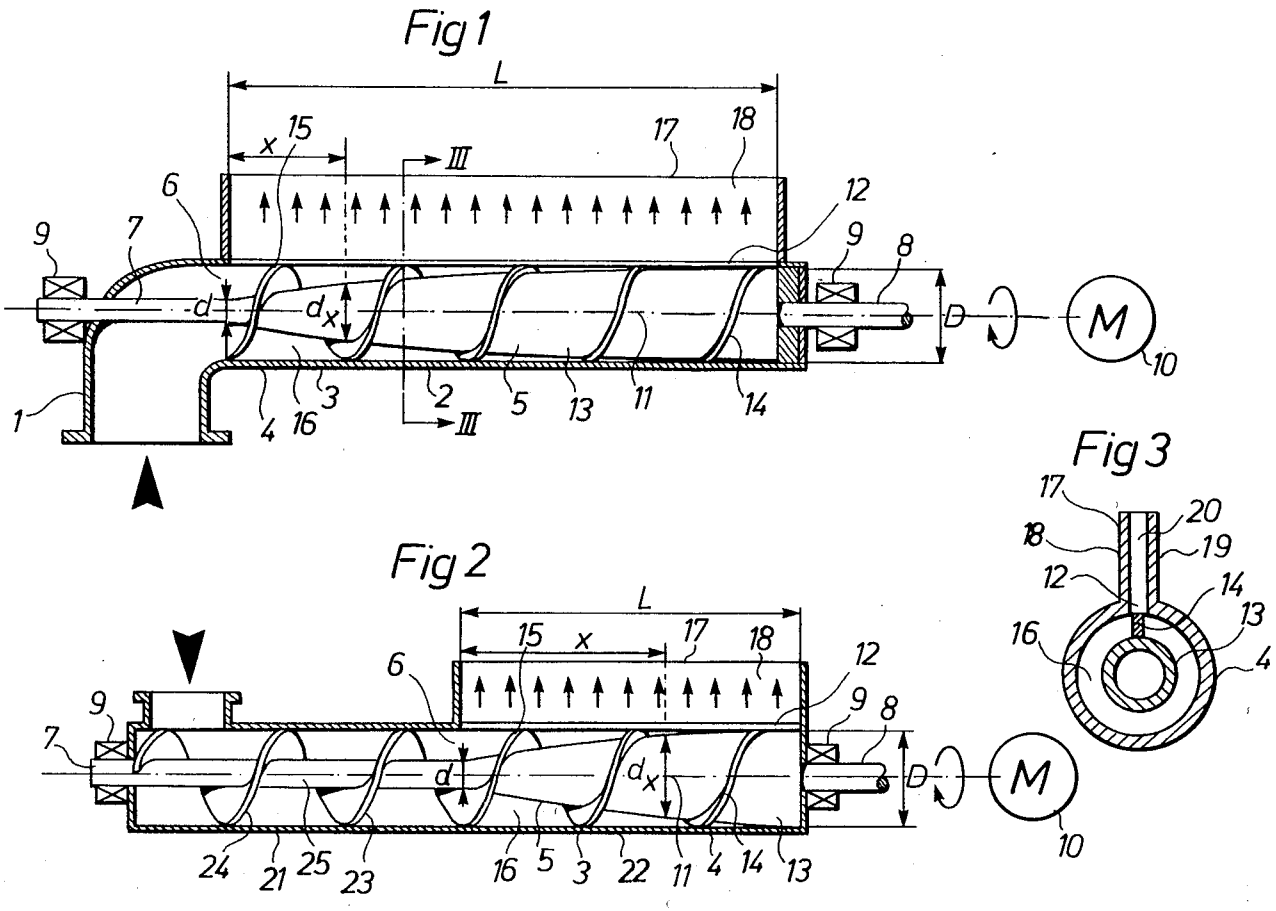
FIG. 1 shows schematically in longitudinal section a discharge apparatus according to the invention.
FIG. 2 shows schematically in longitudinal section a discharge apparatus according to another embodiment of the invention.
FIG. 3 is a cross section of the discharge apparatus along the line III—III in FIG. 1.

With reference to the drawings, which illustrate preferred embodiments of the invention, FIGS. 1 and 3 schematically show a discharge apparatus comprising an inlet unit 1 and a screw discharging unit 2. The screw discharging unit 2 comprises an elongate screw housing 3 with a cylindrical casing wall 4 and a screw 5 rotatably mounted in the screw housing. The screw housing 3 has an inlet end 6 which is in direct communication with the inlet unit 1. The inlet unit is provided with or connected to a suitable pump (not shown) for supplying material to the screw discharging unit at a desired flow. A volumetric pump is preferably used.

The screw 5 is supported by two opposing shafts 7, 8, axially aligned with each other and extending through bearings 9, one shaft 8 being connected to a motor 10 for rotation of the screw about its longitudinal axis 11.

The screw discharging unit 2 is provided with an outlet in the casing wall 4 in the form of an elongate, narrow slot or aperture 12 running parallel to the longitudinal axis 11 of the screw and extending along the entire length of the screw. At least the width of the aperture may be adjustable to adapt the aperture area to different operating conditions.

The screw 5 comprises a central core 13 and a screw blade 14 carried by the core and having a predetermined pitch. The diameter of the screw core 13 increases in the direction from the inlet end 6. The core 13 of the screw and casing wall 4 thus define a space or chamber 16 having a substantially annular cross section area (FIG. 3) which decreases in the direction of feed of the screw seen from the inlet end 6 to the end located downstream of the screw, i.e. the decrease of the cross section area is to be found within the length of the aperture 12 (said cross section area is interrupted by the screw blade 14, but can be generally termed annular). The outer edge 15 of the screw blade has constant radius and is located near the inner surface of the casing wall 4 for sealing cooperation with each other. Due to the shape of the screw core 13 described above, the effective height of the screw blade 14 above the surface of the core 13 will decrease correspondingly from the inlet end 6. In the preferred embodiment shown in FIG. 1, the screw core is parabolic in shape, but it may alternatively be a truncated cone. Seen in longitudinal section, therefore, the outline of the core shown describes an exponential curve, whereas the outline of a truncated cone core is rectilinear.

Provided that no recirculation of the material is desired, said cross section area approaches the value zero at the end of the aperture 12 facing away from the inlet 6.

The discharge apparatus is provided along the length of the aperture 12 with a nozzle 17 having two opposing walls 18, 19 which define a channel 20 communicating with the aperture 12. The material is supplied to the screw discharging unit at a sufficient rate to maintain said space 16 continuously full of material.

Shaping the screw in the manner described, so that a material receiving space 16 is formed which decreases in a predetermined manner in the feed direction along the length of the aperture 12, has enabled the same volume of discharged material to be obtained per unit time and per unit length of the aperture, as illustrated by arrows of the same size in FIG. 1. Contrary to commercially available headboxes, a discharge apparatus according to the invention used as a headbox provides controlled discharge of the material per unit length of the discharge aperture.

Figure 4:
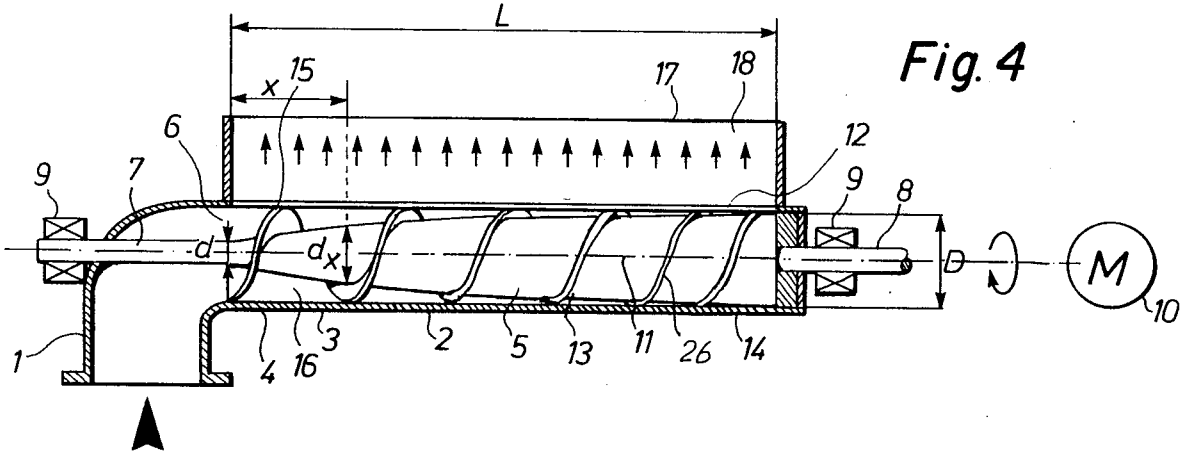
FIG. 4 is a modified embodiment of the discharge apparatus according to FIG. 1.

In the embodiment shown in FIG. 1, the screw blade has a constant pitch. FIG. 4 shows a modified embodiment of the screw 5 wherein the screw blade 26 has a successively decreasing pitch in the direction of feed.

Figure 5:
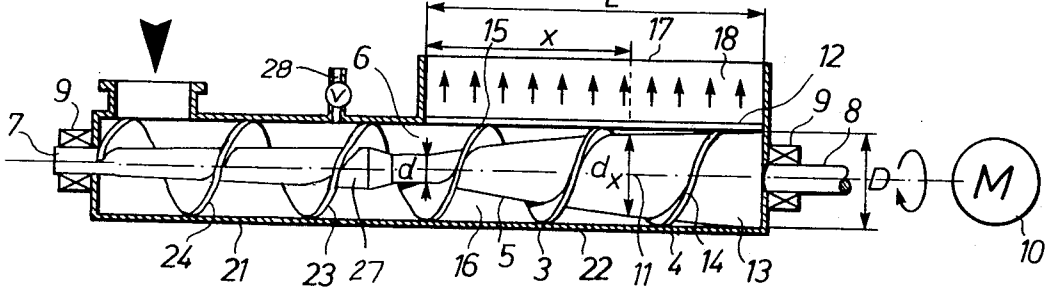
FIG. 5 is a modified embodiment of the discharge apparatus according to FIG. 2.

FIG. 2 schematically shows a second embodiment of a discharge apparatus according to the invention, comprising an inlet unit 21 and a screw discharging unit 22 axially aligned therewith, the latter being substantially equivalent to that shown in FIG. 1 apart from its length. The same reference numbers used in the figures therefore denote corresponding parts. The inlet unit 21 includes a dosing screw which is in direct communication with the screw discharging unit 22 and is provided with a screw 23 having constant pitch on the screw blade 24 and a core 25 with constant diameter. The cores 13 and 25 of the screws 5 and 23, respectively, are permanently joined together to provide an integral, rotating screw unit. The inlet unit 21 may suitably be supplemented with means for removing air from the material before it reaches the screw discharging unit 22 itself. The casing wall of the inlet unit 21 is thus provided at the top with a suitable valve through which the air collected is removed. In this case, it is desirable to compress the material in order to force any air out of the material and up to said valve. Such a compression can be achieved by giving the screw blade in the inlet unit a decreasing pitch and/or giving the core an increasing diameter in the direction of the screw discharging unit. FIG. 5 illustrates a modification of the inlet unit 21 as indicated wherein the core 27 of the screw 23 is formed with an increasing diameter in the direction of the screw discharging unit. The collected air is removed through a valve connection 28.

In a screw discharing unit with a core of the preferred parabolic form, its diameter $d_x$ is altered in the direction from the inlet end in accordance with the following equation:

$$d_x = \sqrt{d^2\left(1 - \frac{x}{L}\right) + D^2\frac{x}{L}} \quad (1)$$

wherein d is the smallest diameter of the core at the inlet end,

D is the largest diameter of the core at the downstream end,

L is the length of the aperture 12, and x is a selected distance of L calculated from the inlet end.

For a core in the form of a truncated cone the diameter $d_x$ is altered in accordance with the following equation:

$$d_x = d + \frac{x}{L}(D - d) \quad (2)$$

As an example, it can be stated that a screw discharging unit according to the invention, which has an aperture with a length of 200 cm and is supplied with material in an amount of 2,000 liters/min, will discharge the material in a volume per unit time and unit length of 10 liters/min.cm at each value of $d_x$ in accordance with the above equations.

The discharge apparatus according to the invention is particularly useful as a headbox for a paper machine where it is of the utmost importance that the stock is discharged with a uniform flow across the web being formed. An essential advantage is that the stock can thus be given a higher fiber concentration, up to 9–12%, for instance, than has been possible in headboxes previously used. The discharge apparatus can also be used in drum presses to provide a uniform flow of material per unit width with respect to the web of material in the drum press. Such drum presses are used to dewater wet bark or a suspension of fiber material such as peat, for instance, and produce more uniform dewatering when equipped with a discharge apparatus according to the invention. In general, the discharge apparatus according to the invention can be used to feed out any type of material in particle form and liquid form and mixtures thereof, which materials can be transported in a mechanical way.

When the discharge apparatus is used as a headbox for a paper machine, for instance, the two walls 18, 19 form lips of the nozzle 17, e.g. upper and lower lips. An advantage directly resultant from the invention is that no reinforcing means such as radial stiffening fins, for instance, need be arranged on the lips, nor any throttle means to regulate the outlet slot of the nozzle and thus the flow, since the discharge apparatus per se provides a controlled supply so that the material is fed out at the same volume per unit time and per unit length of the aperture, even if the nozzle channel changes. In the embodiments shown, the distance between the lips towards the discharge gap is constant. Furthermore, the nozzle is designed for a radial flow of material. In alternative embodiments the lips may converge towards the outlet slot. Instead of a radial flow of material, the nozzle may be arranged for tangential discharge of the material from aperture 12, in which case two discharge apparatuses according to the invention, with such tangential nozzles, may be arranged close together to produce a paper web consisting of two layers. The nozzles may be built as a unit so that one lip is common for forming an intermediate lip, or alternatively they may be arranged at a predetermined distance from each other such that the nozzles form a narrow gap between them for the supply of air between the two layers being discharged. A plastic foil may be arranged in the air gap, if desired. By modifying the latter embodiment with a third headbox arranged behind the first two for the introduction of a layer in said air gap, a paper web of three layers can be produced.

In the drawings and specification there have been set forth preferred embodiments of the invention, and although specific terms are employed, they are used in a generic and descriptive sense only and not for purposes of limitation.

That which is claimed is:

1. An apparatus for discharging material through an elongate aperture in a substantially constant amount per unit length of said aperture, comprising a screw discharging unit having an inlet end, a screw housing including a cylindrical casing wall, and a screw rotatably mounted in the screw housing, an elongate aperture provided in said cylindrical casing wall extending lengthwise a substantial distance along the length of said screw and substantially parallel to the axis of rotation of said screw, said screw having a core with a cross sectional area which increases in the direction of feed of the screw and at least one screw blade extending around the core and having a predetermined pitch for feeding the material from said inlet end to and along the length of said elongate aperture, and wherein said core and said casing wall define a space therebetween having an annular cross section area successively decreasing in the direction of feed of the screw.

2. An apparatus according to claim 1, wherein said core has a truncated cone surface.

3. An apparatus according to claim 1 wherein said screw blade of the screw discharging unit has a constant pitch.

4. An apparatus according to claim 1 wherein said screw blade of the screw discharging unit has a decreasing pitch in the direction from the inlet end.

5. An apparatus according to claim 1 including an inlet unit communicating with the inlet end of said screw discharging unit, said inlet unit including an inlet housing and a screw rotatably mounted in the inlet housing.

6. An apparatus according to claim 5 wherein said screw of the inlet unit and said screw of the screw discharging unit are axially aligned to each other and interconnected to form a rotating unit.

7. An apparatus according to claim 5 wherein said screw of the inlet unit has a cylindrical core and a screw blade with a constant pitch.

8. An apparatus according to claim 5 wherein said screw of the inlet unit has a core the diameter of which increases in the direction of said screw discharging unit whereby the material is subjected to compression during its passage through the inlet unit to remove any air present in the material, and wherein said inlet unit includes a valve means for the removal of air collected during the compression.

9. An apparatus according to claim 5 wherein said screw of the inlet unit has a screw blade with a decreasing pitch in the direction of said screw discharging unit whereby the material is subjected to compression during its passage through the inlet unit to remove any air present in the material, and wherein said inlet unit includes a valve means for the removal of air collected during the compression.

10. An apparatus according to claim 1 wherein the cross section area of said space between said core and said casing wall approaches the value of zero in the direction of feed of the screw.

11. An apparatus according to claim 1 wherein said core has a parabolic surface.

12. An apparatus for discharging material through an elongate aperture in a substantially constant amount per unit length of said aperture, and comprising an inlet unit having an inlet end and a screw discharging unit axially aligned therewith, said inlet unit and said screw discharging unit each including a screw housing with a cylindrical casing wall and a screw rotatably mounted in the screw housing, an elongate aperture provided in said casing wall of the screw discharging unit and extending lengthwise, a substantial distance along the length of said screw discharging unit and substantially parallel to the axis of rotation of said screw discharging unit being in axial alignment and interconnected to form a rotating unit, and each having a core and at least one screw blade extending around the core and having a predetermined pitch for feeding the material from said inlet end to and along the length of said elongate aperture said core of said screw discharging unit having a cross sectional area which increases in the direction of feed of the screw and wherein said core and said casing wall of said screw discharging unit define therebetween a space having an annular cross section area successively decreasing in the direction of feed of the screw.

13. A headbox for a paper machine for discharging papermaking stock through an elongate aperture to a nozzle in a substantially constant amount per unit length of said aperture, said headbox comprising a screw discharging unit having an inlet end, a screw housing including a cylindrical casing wall, a screw rotatably mounted in the screw housing, an elongate aperture provided in said cylindrical casing wall extending lengthwise, a substantial distance along the length of said screw substantially parallel to the axis of rotation of said screw, and a nozzle having a pair of opposing walls extending from said casing wall along the length of said aperture and defining a channel communicating with said aperture, said screw having a core with a cross sectional area which increases in the direction of feed of the screw, at least one screw blade extending around the core and having a predeterminded pitch for feeding the papermaking stock from said inlet end to and along the length of said elongate aperture, and wherein said core and said casing wall define a space therebetween having an annular cross section area successively decreasing in the direction of feed of the screw.

* * * * *